US005398051A

United States Patent [19]

Fukui et al.

[11] Patent Number: 5,398,051

[45] Date of Patent: Mar. 14, 1995

[54] TRANSFER MEMBER THERMAL TRANSFER RECORDING METHOD USING AN INTERMEDIATE

[75] Inventors: Yasuo Fukui, Kadoma; Soichirou Mima, Nishinomiya; Hiroyuki Matsuo, Neyagawa; Akihiro Imai; Nobuyoshi Taguchi, both of Ikoma, all of Japan

[73] Assignee: Matsushita Electric Industrial Co., Ltd., Osaka, Japan

[21] Appl. No.: 50,646

[22] Filed: Apr. 22, 1993

[30] Foreign Application Priority Data

Apr. 22, 1992 [JP] Japan ..... 4-102607

[51] Int. Cl.[6] ..... B41J 2/325; B41M 5/28

[52] U.S. Cl. ..... 347/213; 346/135.1

[58] Field of Search ..... 346/1.4, 76 PH, 135.1; 400/120; 503/227

[56] References Cited

U.S. PATENT DOCUMENTS

| | | | |
|---|---|---|---|
| 4,882,593 | 11/1989 | Touma et al. | 346/1.1 |
| 5,263,781 | 11/1993 | Mima et al. | 400/120 |
| 5,284,814 | 2/1994 | Taguchi et al. | 503/227 |

FOREIGN PATENT DOCUMENTS

| | | |
|---|---|---|
| 0262595 | 4/1988 | European Pat. Off. . |
| 0378291 | 7/1990 | European Pat. Off. . |
| 3 341 961 | 5/1984 | Germany . |
| 62-68788 | 3/1987 | Japan . |

OTHER PUBLICATIONS

Patent Abstracts of Japan, vol. 14, No. 196 (M-964), 1990; & JPA-2038056 (Matsushita Electric Ind. Co. Ltd.); abstract.

*Primary Examiner*—Benjamin R. Fuller
*Assistant Examiner*—Huan Tran
*Attorney, Agent, or Firm*—Wenderoth, Lind & Ponack

[57] ABSTRACT

A thermal transfer recording method for recording, in which an intermediate transfer member having a recording layer formed on a polymeric layer is used in such a way that the intermediate transfer member and an ink sheet is placed one over the other, dye being thermally transferred from an ink material layer of the ink sheet to the recording layer. The intermediate transfer member and an image receiving medium are placed one over the other, and they are subjected to pressure and heat so that the recording layer is transferred from the intermediate transfer member onto the image receiving medium.

18 Claims, 4 Drawing Sheets

TRANSFER MEMBER THERMAL TRANSFER RECORDING METHOD USING AN INTERMEDIATE

BACKGROUND OF THE INVENTION

1. Field of the Invention

The present invention relates to a thermal transfer recording method in which an ink material containing a coloring material comprised of a dye is used for the purpose of recording in such a way that the dye is transferred onto paper or the like by recording means, such as a thermal head.

2. Description of the Prior Art

Hitherto, there has been known a thermal transfer recording method in which recording is effected through the sublimation or diffusion of a dye as a coloring material. According to this known method, an ink sheet comprising a heat resistant base, such as polyethylene terephthalate (PET) film or condenser paper, and an ink material layer of about 3 μm in thickness formed on the surface thereof and comprised of a dye and a binder material is used so that the dye of the ink sheet is transferred directly on a dye-receptive recording medium by a recording head, whereby recording is effected.

The foregoing conventional thermal transfer recording method will be further described with respect to its constitutional aspect and the mode of carrying out the method.

An ink sheet having an ink material layer comprised of a coloring material and a binder material and formed on a heat resistant base, and an image receiving medium, such as recording paper or the like, are pressed in an interface between the thermal head and a platen roller. The thermal head is caused to produce heat in response to a signal from a recording signal source so as to selectively heat up the ink material. Upon separation of the ink sheet from the image receiving medium, a part of the coloring material in the ink material layer is transferred onto the image receiving medium to provide a transferred image.

With the foregoing arrangement, however, the amount of coloring material transfer will vary widely depending upon the type of surface material of the image receiving medium. Since the ink material layer is heated up to cause sublimation or diffusion of the coloring material comprised of a dye for transfer of the coloring material onto the image receiving medium, recording is possible only where the surface material of the image receiving medium is receptive to the dye, and the amount of coloring material transfer depends upon the dye receptivity of surface material of the image receiving medium. For example, where common paper is used as an image receiving medium, image recording through dye transfer can hardly be obtained, because the surface of the paper has little dye receptivity, if any.

Further, with the above described arrangement, the quality of a recorded image varies considerably depending upon the surface condition of the image receiving medium. Any difference in the condition of contact between the image receiving medium and the ink material layer is reflected as a difference in recorded image density and, therefore, the uniformity of the recorded image depends upon the surface smoothness of the image receiving medium. For example, where the image receiving medium has considerable surface irregularity, unsatisfactory contact is unavoidable between the image receiving medium and the ink material layer and, therefore, no uniform image recording can be achieved.

SUMMARY OF THE INVENTION

The present invention has as its object the provision of a thermal transfer recording method which makes it possible to give satisfactory transfer-recorded image quality through dye transfer irrespective of a kind of the image receiving medium (i.e., surface material and surface condition).

The present invention relates to a thermal transfer recording method comprises using an intermediate transfer member comprising at least a base, a polymeric layer having rubber elasticity and self-adhering property and a recording layer having dye-receptivity laminated in this order on the base, placing an ink material layer of an ink sheet on the recording layer, thermally transferring dye from the ink material layer to the recording layer, then separating the ink sheet, subsequently placing an image receiving medium on the recording layer, causing the recording layer to go into adhesion contact with the image receiving medium, and then separating the image receiving medium to which the recording layer has been transferred.

DETAILED DESCRIPTION OF THE INVENTION

Figure 1:
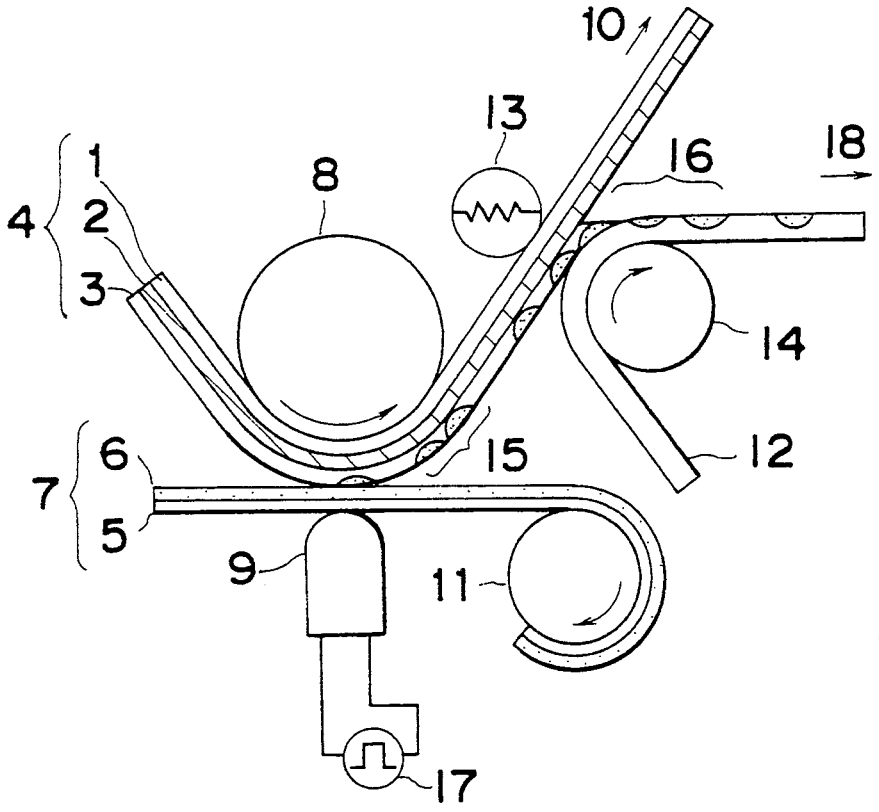
FIG. 1 is a schematic view showing by way of example the constitutional aspect of the thermal transfer recording method with respect to one embodiment of the present invention.

The present invention provides a thermal transfer recording method comprising:

using an intermediate transfer member, the member comprising at least a base, a polymeric layer having rubber elasticity and self-adhering property and a recording layer having dye-receptivity laminated in this order on the base;

placing an ink material layer of an ink sheet on the recording layer, thermally transferring dye from the ink material layer to the recording layer;

separating the ink sheet;

then mounting an image receiving medium on the recording layer, then separating the image receiving medium thereby to transfer the recording layer onto the image receiving medium.

The polymeric layer having rubber elasticity and self-adhering property is comprised of a polymeric material having rubber elasticity and a polymeric material having self-adhering property.

The polymeric material having rubber elasticity contains a silicone material having rubber elasticity.

The polymeric material having self-adhering property contains a silicone material having self-adhering property.

The silicone material having self-adhering property is a silicone pressure sensitive adhesive containing silicone raw rubber and silicone resin.

In the thermal transfer recording method of the invention, the ink sheet is separated from the recording layer under a temperature condition such that the temperature of the recording layer is lower than a glass transition point of a thermal plastic resin contained in the recording layer.

Also, in the thermal transfer recording method, the image receiving medium is separated from the recording layer under a temperature condition such that the temperature of the recording layer is lower than a flow point of a thermoplastic resin contained in the recording layer, so that the recording layer is transferred onto the image receiving medium.

Also, in the thermal transfer recording method, a transfer preventive layer may be partially formed on the recording layer so that only a desired portion of the recording layer is transferred onto the image receiving medium.

A thermal transfer recording method of the invention is further explained in more detail below.

A dye is first thermally transferred from an ink material layer to a recording layer. In this case, by virtue of the self-adhering property of the polymeric layer, the recording layer is stably held on the polymeric layer. Further, the fact that the polymeric layer has rubber elasticity assures uniform contact among the thermal head, the ink sheet and the recording layer of the intermediate transfer member. This provides for stable formation of a primary recorded image of high image quality on the recording layer.

Then, an image receiving medium is pressed against the recording layer on the polymeric layer and heat is applied to such an extent as to permit the recording layer to become softened, thereby the recording layer is transferred onto the image receiving medium. In this case, because of the fact that the polymeric layer has rubber elasticity, the polymeric layer is elastically deformed in accordance with the surface irregularity of the image receiving medium so that the recording layer fills up concave portions on the image receiving medium. Therefore, even if the surface of the image receiving medium is made irregular with fibers or the like, the recording layer and primary recorded image are satisfactorily fixed simultaneously onto the surface of the image receiving medium.

Because of the fact that the polymeric layer having rubber elasticity and self-adhering property is comprised of a polymeric material having rubber elasticity and a polymeric material having self-adhering property, the rubber elasticity property and the self-adhering property may be set respectively to optimum conditions. Therefore, it is possible to form a polymeric layer which will satisfactorily fill up the surface irregularity of any image receiving medium without detriment to the self-adhering feature, and thus to effect image recording on various different image receiving mediums.

The inclusion of a silicone material having rubber elasticity in the polymeric material having rubber elasticity results in increased rubber elasticity, and also enables the provision of an intermediate transfer member which is less liable to deterioration by heat.

The inclusion of a silicone material having self-adhering property in the polymeric material having self-adhering property results in further improved self-adhering property, and also enables the provision of an intermediate transfer member which is less liable to deterioration by heat.

The inclusion of a silicone pressure sensitive adhesive containing silicone raw rubber and silicone resin as the silicone material having self-adhering property enables control of self-adhering characteristics, and it is thus possible to provide sufficient cohesive force and excellent adhesivity.

The ink sheet is separated from the recording layer under a temperature condition such that the temperature of the recording layer is lower than a glass transition point of a thermoplastic resin contained in the recording layer. The recording layer can be more stably held on the polymeric layer.

The image receiving medium is separated from the recording layer under a temperature condition such that the temperature of the recording layer is lower than a flow point (fluidization-starting point) of a thermoplastic resin contained in the recording layer. The recording layer and primary recorded image can be more satisfactorily transferred onto the surface of the image receiving medium.

Further, an intermediate transfer member having a transfer preventive layer partially formed on the recording layer may be used. In this case, it becomes possible that the recording layer which underlies the transfer preventive layer does not transfer onto the image receiving medium when the image receiving medium is separated for transfer of the recording layer onto the image receiving medium. In an intermediate transfer member having polymeric and recording layers continuously formed as such, therefore, it is possible that only a necessary portion or portions of the recording layer are selectively transferred onto the image receiving medium. This arrangement of the transfer preventive layer also facilitates pattern registration and the like during the process of preparing an intermediate transfer member.

As above described, according to the present invention, in thermal dye transfer recording an image is formed on a recording layer having dye-receptivity and, in turn, the recording layer is transferred onto an image receiving medium. Therefore, image recording of high image quality can be effected on any image receiving medium the type of which is so rough-surfaced that uniform recording has been impossible with it in the past. The method of the invention enables recorded images to be effectively transferred onto any kinds of image receiving mediums to which the recording layer is transferrable. In principle, according to the invention, image recording can be effected with all kinds of recording paper, including paper, which can well serve as image receiving mediums; any special type of paper having good dye-receptivity, such as coated paper, is not particularly required. Therefore, it is possible to produce recorded images of good quality by use of a dye as a coloring material, irrespective of the kind of the image receiving medium (i.e., surface material and surface condition ).

DETAILED DESCRIPTION OF THE PREFERRED EMBODIMENTS

The thermal transfer recording method of the invention with respect to one embodiment will now be described with reference to the accompanying drawings.

FIG. 1 is a schematic view showing one constitutional aspect of the thermal transfer recording method. In FIG. 1, the reference numeral 4 designates an intermediate transfer member; 7 designates an ink sheet; 9 designates a thermal head; 12 designates an image receiving medium; and 13 designates a heating roller. The intermediate transfer member 4 comprises a sheet-form heat resistant base or A base 1, and a polymeric layer 2 and a recording layer 3 which are formed on the A base 1. The ink sheet 7 comprises a similar sheet-form heat resistant base or B base 5, and an ink material layer 6 formed thereon. The thermal head 9 is employed for recording purposes, and for transfer operation are employed the heating roller 13 and a roller 14.

The operation of the above described arrangement as employed in carrying out the thermal transfer recording method will be explained with reference to FIGS. 1 and 2 in particular.

In FIG. 1, with the intermediate transfer member 4 and the ink sheet 7 as pressed against the interface between a platen 8 and the thermal head 9, the thermal head 9 is caused to selectively generate heat in response to a signal from a recording signal source 17, so that at least a part of the coloring material of the ink material layer 6 is transferred onto the recording layer 3 of the intermediate transfer member 4, whereby a primary recorded image 15 corresponding to the recording signal is formed on the intermediate transfer member 4. As the platen 8 rotates, the intermediate transfer member 4 is fed in the direction of arrow 10, and the ink sheet 7 is wound onto an ink sheet take-up roller 11.

In this case, the recording layer 3 is stably held on the polymeric layer 2 by virtue of the self-adhering property of the polymeric layer 2. Therefore, though recording layer 3 is liable to go into melt contact with the ink material layer 6, it is subject neither to separate from the polymeric layer 2 nor to slip out of position thereon even when shearing force is exerted on the recording layer 3 due to changes in the running velocity of the intermediate transfer member 4 or of the ink sheet 7. Moreover, the rubber elasticity of the polymeric layer 2 permits the polymeric layer 2 to be elastically deformed conforming to the surface irregularity of the ink sheet 7 and of the thermal head 9, and this provides uniform contact between the thermal head 9, the ink sheet 7, and the recording layer 3 on the intermediate transfer member 4. Accordingly, a high quality primary recorded image 15 can be stably formed on the recording layer 3.

Nextly, the intermediate transfer member 4 and an image receiving medium 12 are placed one over the other and, under pressure applied by the heating roller 13 and roller 14, the base side of the intermediate transfer member 4 is heated by the heating roller 13, whereupon the recording layer 3 comes into adhesive bond with the surface of the image receiving medium 12. Therefore, when the image receiving medium 12 is separated from the intermediate transfer member 4, that part of the recording layer 3 which has been subjected to pressure is peeled off from the remaining part of the recording layer 3 for transfer onto the image receiving medium 12. Thus, a corresponding primary recorded image 15 is transferred onto the surface of the image receiving medium 12 to form a transferred image 16. The image receiving medium 12 is fed in the direction of the arrow 18 as the roller 14 rotates.

In this case, even if the surface of the image receiving medium 12 is irregular due to presence of fibers thereon, the rubber elasticity of the polymeric layer 2 permits the polymeric layer 2 to be elastically deformed corresponding to the surface irregularity of the image receiving medium 12 so that the recording layer 3 is minutely received into depressions in the surface of the image receiving medium 12. When pressed further, the flexible polymeric layer 2 is allowed to penetrate into surface depressions of the image receiving medium 12, whereby the recording layer 3 is forced further deep into minute fiber interstices. When the adhesivity of the recording layer 3 relative to the image receiving medium 12 has become greater than the tack strength of the recording layer 3 relative to the polymeric layer 2, the image receiving medium 12 is separated from the intermediate transfer member 4, whereupon the recording layer 3 which has become softened is released from the polymeric layer 2 for being transferred onto the image receiving medium 12. Thus, the recording layer 3 and primary recorded image 15 are readily transferred onto the surface of the image receiving medium 12 at such a temperature as to allow the recording layer 3 to become softened and, simultaneously thereupon, they are effectively interlocked in position.

It is to be noted that the transferred image 16 is an inverted image relative to the primary recorded image 15. Therefore, the recording signal source 17 usually issues a signal such that the transferred image 16 is caused to be recorded by the thermal head 9 in the form of an inverted image.

For purposes of color recording is used an ink sheet 7 having ink material layer 6 in this order arranged on a B base 5 for three primary colors, i.e., cyan, magenta, and yellow, or for four primary colors, i.e., the three colors and black. These different color ink material layers are transferred in superposed relation onto the intermediate transfer member 4, whereby a color recorded image can be obtained.

Figure 2:
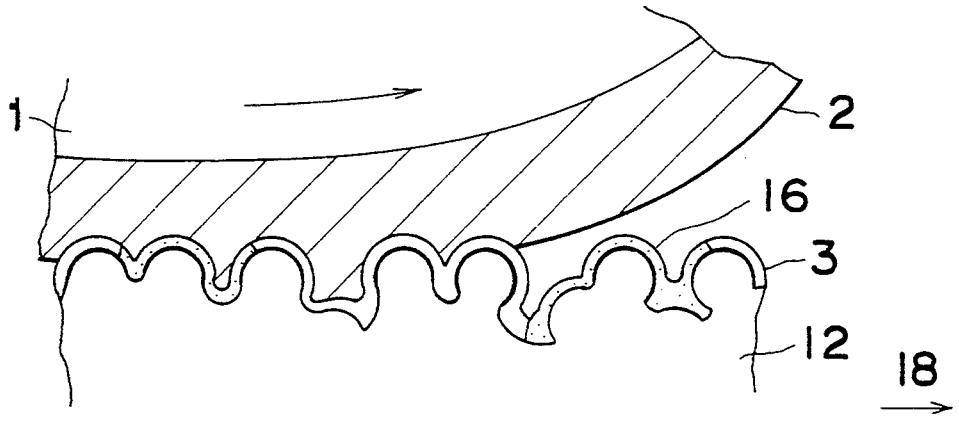
FIG. 2 is a sectional view explanatory of the manner of operation with respect to the embodiment, showing a recording layer as it becomes fixed.

FIG. 2 is a sectional view showing the transferred image 16 in FIG. 1 as satisfactorily fixed in position on an image receiving medium 12 having surface irregularity. The mechanism of recording-layer transfer will be explained with reference to this FIG. 2.

In FIG. 2, as pressure and heat are applied by the heating roller 13 from the A base 1 side of the intermediate transfer member, the recording layer 3 goes into adhesion bond with the surface of the image receiving medium 12. The surface of the image receiving medium 12 is seen irregular due to the presence of fibers, but the polymeric layer 2 follows the surface irregularity of the image receiving medium 12 to permit the recording layer 3 to be loaded into surface depressions of the image receiving medium 12. Further application of pressure enables softened polymeric layer 2 to penetrate deep into the surface depressions, with the result that the recording layer 3 is forced further into finer fiber interstices. As a consequence, the recording layer 3 presents the same rough and irregular surface as the original surface of the image receiving medium as shown in FIG. 2.

Generally, the luster and write-on fitness of an image receiving medium are determined by the surface irregularity of the medium. Inasmuch as the recording layer 3 can follow a rough surface irregularity of the image receiving medium 12, the recording layer 3 will present a surface condition identical with the original surface of the image receiving medium 12, being thus well fit for purposes of writing-on characters by a writing implement, such as a pencil. Further, the recording layer 3 is able to become firmly fixed on the image receiving medium 12, and this provides for further improvement in the fixation of recorded images.

Figure 3:
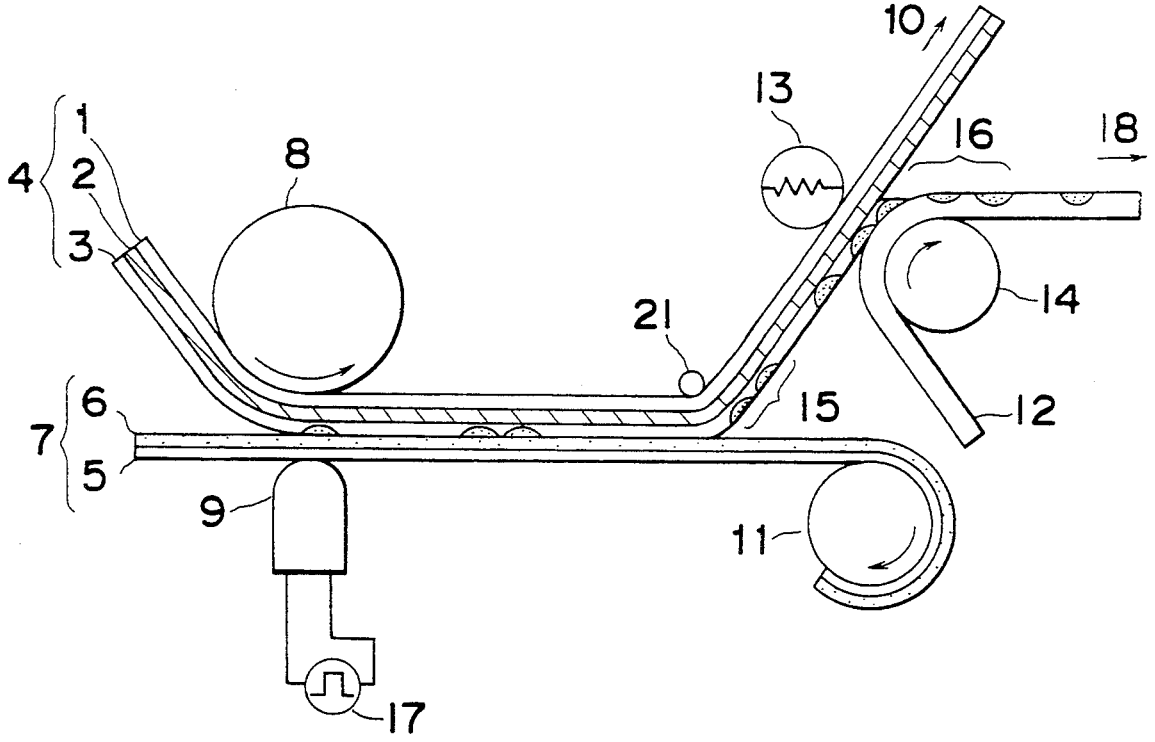
FIG. 3 is a schematic view showing another form of arrangement employed in the thermal transfer recording method of the invention.

FIG. 3 is a schematic view showing another form of arrangement employed in the thermal transfer recording method of the invention. The arrangement in FIG. 3 differs from that shown in FIG. 1 in that an ink sheet separating roller 21 is disposed at a location distant from the tip of the thermal head 9 for separating the ink sheet 7 from the intermediate transfer member 4.

Operation of the above described arrangement in carrying out the thermal transfer recording method will now be described with reference to FIG. 3.

In FIG. 3, with the intermediate transfer member 4 and ink sheet 7 as pressed against the interface between the platen 8 and the thermal head 9, the thermal head 9 selectively generates heat in response to a signal from the recording signal source 17 so that at least a part of the coloring material of the ink material layer 6 is transferred onto the surface of the recording layer 3 of the intermediate transfer member 4. Thus, a primary recorded image 15 corresponding to the recording signal is formed on the intermediate transfer member 4. As the platen 8 rotates, the ink sheet 7 and intermediate transfer member 4 are fed in the direction of arrow 10, and the ink sheet 7 is separated from the intermediate transfer member 4 by means of the ink sheet separating roller 21, the separated ink sheet 7 being wound onto the ink sheet take-up roller 11 accordingly.

According to the arrangement shown in FIG. 1, the ink sheet 7 is separated from the intermediate transfer member 4 at the tip of the thermal head 9. Therefore, at the time of the ink material layer 6 being separated from the recording layer 3, the temperature of the recording layer 3 varies according to the condition of heat accumulation at the thermal head 9. That is, where the degree of heat accumulation at the thermal head 9 is relatively small, the temperature of the recording layer 3 at the time of the ink material layer 6 being separated from the recording layer 3 is relatively low, while on the other hand where heat accumulation at the thermal head 9 is significant, the temperature of the recording layer 3 at the time of the ink material layer 6 being separated from the recording layer 3 is relatively high.

It is to be noted in this connection that how stably can the recording layer 3 be held on the polymeric layer 2 because of the self-adhering property of the polymeric layer 2 depends upon whether the temperature of the recording layer 3 is higher or lower than the glass transition point of the thermoplastic resin contained in the recording layer 3. Where the temperature of the recording layer 3 is lower than the glass transition point of the thermoplastic resin contained in the recording layer 3, the cohesive power of the recording layer 3 is very high so that the recording layer 3 is well stably held on the polymeric layer 2 because of the self-adhering property of the polymeric layer. On the other hand, however, where the temperature of the recording layer 3 is higher than the glass transition point of the thermoplastic resin contained in the recording layer 3, the recording layer 3, which has become softened, is liable to deformation under shearing force exerted thereon as a consequence of thermal adhesion of the recording layer 3 with the ink material layer 6 and/or a change in the run velocity of the intermediate transfer member 4 or of the ink sheet 7, so that the recording layer 3 may no longer be held on the polymeric layer even with the self-adhering property of the polymeric layer 2. Thus, the recording layer 3 may become separated from the polymeric layer 2 or slip out of position on the polymeric layer 2.

As such, with the arrangement shown in FIG. 1, where heat accumulation at the thermal head is large, the temperature of the recording layer 3 at the time of the ink material layer 6 being separated from the recording layer 3 is higher than the glass transition point of the thermoplastic resin contained in the recording layer 3 and, as a result, the recording layer 3 may not be held on the polymeric layer 2.

In order to avoid such possibility, the arrangement shown in FIG. 3 includes an ink sheet separating roller 21 by which the ink sheet 7 is separated from the intermediate transfer member 4 at a position distant from the tip of the thermal head 9. According to this arrangement, at the time of the ink material layer 6 being separated from the recording layer 3 on the polymeric layer 2, the temperature of the recording layer 3 is lower than the glass transition point of the thermoplastic resin contained in the recording layer 3 irrespective of the condition of heat accumulation at the thermal head. Thus, the recording layer 3 can be stably held on the polymeric layer 2 so that dye can be thermally transferred from the ink material layer 6 to the recording layer 3 in a highly stable manner.

Then, in same way as shown in FIG. 1, the intermediate transfer member 4 and the image receiving medium 12 are placed one over the other, and pressure is applied to them by the heating roller 13 and roller 14, with heat applied by the heating roller 13 from the base side of the intermediate transfer member 4, whereupon the recording layer 3 goes in adhesion bond with the surface of the image receiving medium 12. Therefore, when the intermediate transfer member 4 and the image receiving medium 12 are separated from each other, that part of the recording layer 3 which has been subjected to pressure is peeled off from the remaining portion of the recording layer 3 for being transferred onto the image receiving medium 12. Thus, the primary recorded image 15 is transferred to the surface of the image receiving medium 12 to form a transferred image 16. The image receiving medium 12 is fed in the direction of arrow 18 as the A roller 14 rotates.

Figure 4:
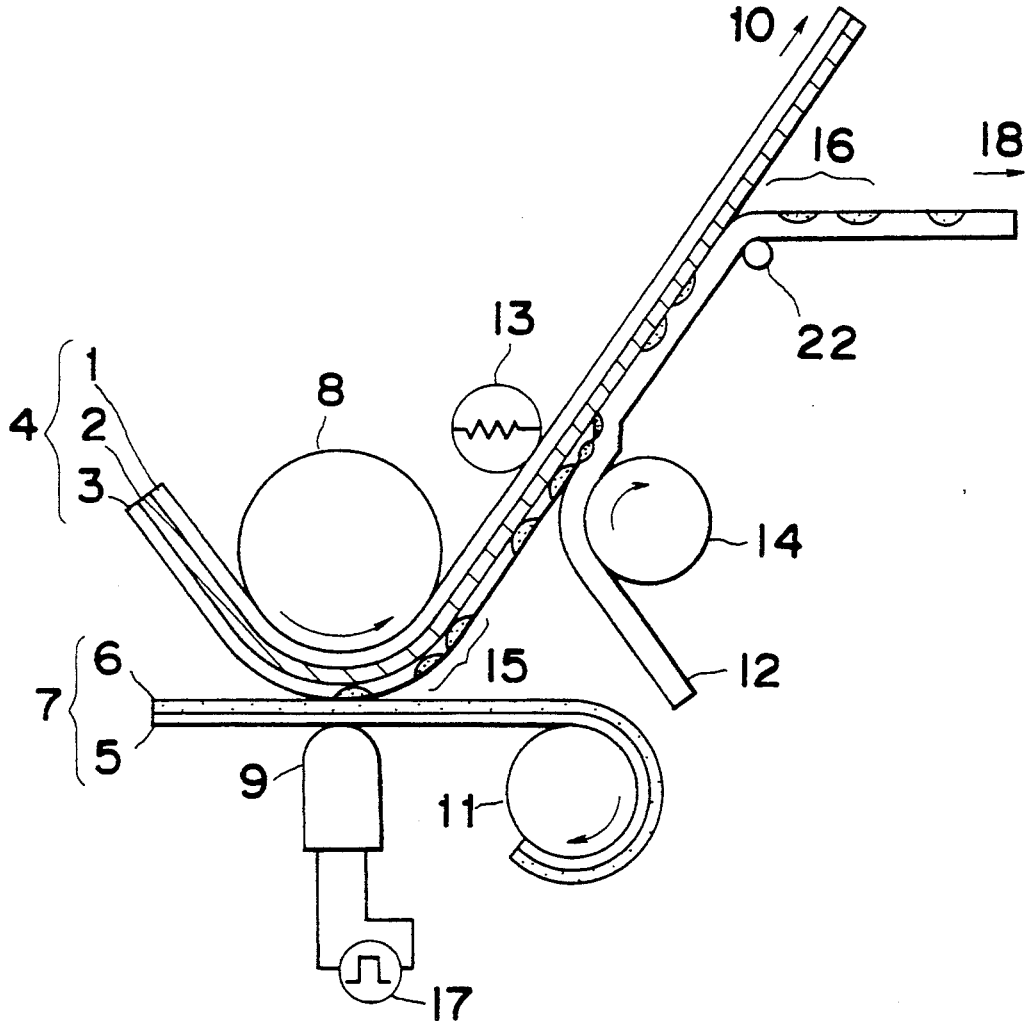
FIG. 4 is a schematic view showing still another form of arrangement employed in the thermal transfer recording method of the invention.

FIG. 4 is a schematic view showing another arrangement employed in the thermal transfer recording method with respect to the embodiment of the invention. The FIG. 4 arrangement differs from that of FIG. 1 in that an image-receiving medium separating roller 22 is provided at a location distant from the heating roller 13 for separating the image receiving medium 12 from the intermediate transfer member 4.

Operation of the above described arrangement in carrying out the thermal transfer recording method will be explained with reference to FIG. 4.

In FIG. 4, first in same manner as in FIG. 1, with the intermediate transfer member 4 and ink sheet 7 as pressed against the interface between the platen 8 and the thermal head 9, the thermal head 9 is caused to selectively generate heat in response to a signal from the recording signal source 17 so that at least a part of the coloring material of the ink material layer 6 is transferred onto the surface of the recording layer 3 of the intermediate transfer member 4, whereby a primary recorded image 15 corresponding to the recording signal is formed on the intermediate transfer member 4. As the platen 8 rotates, the intermediate transfer member 4 is fed in the direction of arrow 10, and the ink sheet 7 is wound on the ink sheet take-up roller 11.

Nextly, the intermediate transfer member 4 and the image receiving medium 12 are placed one over the other, and with pressure applied to them by the heating roller 13 and roller 14, the intermediate transfer member 4 is heated at its base side by the heating roller 13, whereupon the recording layer 3 comes in adhesion contact with the surface of the image receiving medium 12. As the roller 14 rotates, the image receiving medium 12 is transported in the direction of arrow 18 and is separated from the intermediate transfer member 4 by means of the image-receiving medium separating roller 22. That part of the recording layer 3 which has been subjected to pressure by the heating roller 13 and roller 14 is peeled off from the remaining portion of the recording layer 3 and is transferred onto the image receiving medium 12. Thus, the primary recorded image 15 is transferred onto the surface of the image receiving medium 12 to form a transferred image 16.

With the arrangement illustrated in FIG. 1, the image receiving medium 12 is separated from the intermediate transfer member 4 in the vicinity of the heating roller 13, and therefore the temperature of the recording layer 3 at the time of the image receiving medium 12 being separated from the intermediate transfer member 4 roughly corresponds to the temperature of the heating roller 13.

It is to be noted in this connection that how well can the recording layer 3 be transferred from the polymeric layer 2 to the image receiving medium 12 depends upon whether the temperature of the recording layer 3 is higher or lower than the flow point (fluidizing point) of the thermoplastic resin contained in the recording layer 3. Where the temperature of the recording layer 3 is lower than the flow point of the thermoplastic resin contained in the recording layer 3, the cohesive power of the recording layer 3 is very high so that the recording layer 3 is satisfactorily transferred from the polymeric layer 2 to the image receiving medium 12. On the other hand, however, where the temperature of the recording layer 3 is higher than the flow point of the thermoplastic resin contained in the recording layer 3, the recording layer 3 may be subject to cohesive failure so that the recording layer 3 may not completely be transferred onto the image receiving medium 12. This is due to the fact that when the thermoplastic resin contained in the recording layer 3 is heated to a temperature higher than the flow point, its viscosity is lowered to the extent that the resin can begin to flow, so that the recording layer 3 itself may be cut off under forces exerted by both the polymeric layer 2 and the image receiving medium 12.

For this reason, with the arrangement shown in FIG. 1, when the temperature of the heating roller 13 fluctuates upward to the extent that the temperature of the recording layer 3 at the time of the image receiving medium 12 being separated from the intermediate transfer member 4 is made higher than the flow point of the thermoplastic resin contained in the recording layer 3, satisfactory transfer operation may not be possible.

Where an image-receiving medium separating roller 22 is provided as in the arrangement shown in FIG. 4, the image receiving medium 12 is separated from the intermediate transfer member 4 at a location distant from the heating roller 13. Therefore, the temperature of the recording layer 3 at the time of the image receiving medium 12 being separated from the intermediate transfer member 4 can be made lower than the flow point of the thermoplastic resin contained in the recording layer 3 irrespective of the temperature of the heating roller 13. Thus, the recording layer 3 is no longer subject to cohesive failure and the recording layer 3 and primary recorded image 15 can be transferred more satisfactorily onto the surface of the image receiving medium 12.

As described above, in the embodiment of the present invention, an intermediate transfer member comprising a base, a polymeric layer having rubber elasticity and self-adhering property and a recording layer having dye-receptivity, which layers are in this order laminated on the base, is used as such; an ink material layer of an ink sheet is placed on the recording layer, and dye is thermally transferred from the ink material layer to the recording layer; then, after separation of the ink sheet, an image receiving medium is placed on the recording layer to cause the recording layer to come into adhesion contact with the recording layer; and then the image receiving medium is separated from the intermediate transfer member for completion of recording. Through this process, a recorded image can be produced on any kind of image receiving medium to which image transfer from the recording layer is possible. Recording of high image quality can be effected even where the image receiving medium is of the type having rough surface with which uniform recording has hitherto been not possible. Even where an image receiving medium having surface irregularity is used, the transferred recording layer permits writing-on of characters with a writing implement such as a pencil and a recorded image having good fixed effect can be obtained.

The thermal transfer recording method of the invention is not intended to be limited to the method described with respect to the present embodiment in which a thermal head 9 is employed. Means other than thermal head, such as electro-thermal head or optical head, may be employed in the thermal transfer recording method.

A heating roller 13 is employed as transfer means in the embodiment, but alternatively a roller for heat and pressure application may be used. The heating roller 13 has a heat generating section in its interior or on its outer periphery and is adapted to control the quantity of electricity for energizing the heat generating section and to control, through heat conduction via the surface of the roller, the amount of heat to be transferred to the intermediate transfer member. For the heat generating section, a light source having a large heat radiation capacity, such as a halogen lamp, may be used. Examples of rollers suitable for use as the heating roller 13 include rubber (rubber coated), plastic, and metallic rollers. By using a thermo-recording head, such as thermal head or electro thermal head, is it possible to transfer a required portion only of the recording layer (e.g., a primary recorded image portion only of the recording layer) onto the image receiving medium.

The roller 14 may be adapted to perform heating in same way as the heating roller 13 as required. In case where the roller 14 is heated, the heating roller 13 may be constructed as a non-heating roller. In other words, it is possible to arrange for both or either of the two rollers being heated.

Examples of rollers suitable for use as the roller 14 include rubber (rubber coated), plastic, and metallic rollers, as is the case with the heating roller 13.

The intermediate transfer member 4 may be constructed to be rolled around a pay-off roller and a take-up roller in the form of a cassette, though not shown as such in FIG. 1. The same applies with respect to the ink sheet 7.

The ink sheet separating roller 21 (FIG. 3) need not particularly be configured to be a roller as shown. It may be of any other form insofar as it is capable of separating ink sheets. For example, a peeling pawl of the type which is used in a fixing device may be employed, instead of the roller. Or, an end of a thin lamellar member may be used as such. This is same with the image-receiving medium separating roller 22, which need not necessarily be in the form of a roller but may be of any other configuration insofar as it is capable of separating image receiving mediums.

It is particularly desirable with the base 5 of the ink sheet 7 that the base 5 has a lubricating layer or a heat resistant lubricating layer on one side thereof to provide good run stability relative to a recording head. For the base 5 may be used various kinds of polymeric films. In particular, that side of the base 5 which is to contact the ink material layer 6 is preferably comprised of a polymeric film having an adhesive layer (an anchor coat layer) formed thereon in view of the characteristics of the ink material layer 6.

For the base 5 may be used different kinds of polymeric films. The surface of films may be treated by coating or otherwise. Polymeric films useful for this purpose include, for example, polyolefins, polyamides, polyesters, polyimides, polyethers, celluloses, polyparabanic acids, polyoxadiazoles, polystyrenes, and fluoroplastic films. In particular, polyethylene terephthalate (PET), polyethylene naphthalate, aramid, triacetyl cellulose, polypropylene, and cellophane films are useful. The thickness of such polymeric film is usually of the order of 3 to 100 Ìm, preferably of the order of 3 to 30 Ìm. Such polymeric film may have on one side thereof a heat resistant layer formed of a thermosetting resin for reinforcement of the stability of the film against thermal deformation, etc., or an antistatic layer, or various other coat layers, if required.

The ink material layer 6 comprises at least a coloring material and a binder material. The coloring material is not particularly limited in kind, insofar as it includes a thermally transferrable dye. Coloring material useful for the purpose of the invention include disperse dyes, basic dyes, and color formers. For the binder material, there is no particular limitation in kind, and various kinds of polymeric materials and of waxes can be effectively used. The ink material layer 6 may be of a multilayer structure. The ink material layer 6 may have a lubricating layer or various coat layers formed thereon. Also, the ink material layer 6 may have various kinds of additives, such as silicone and fluoroplastic materials, incorporated therein.

The recording layer 3 is formed from at least a polymeric material. Since the ink material layer 6 contains a dye as a coloring material, the recording layer 3 must have dye-receptivity. For the recording layer 3, therefore, polymeric materials which are receptive to disperse dyes and the like are suitably used, including, for example, polyesters, polyacetals, acrylic resins, urethanes, nylons, vinyl acetates, and polybutyrals. In particular, polyesters and polybutyrals are useful as materials which can meet the requirements of dye-receptivity and adhesion to paper.

The recording layer 3 is required to have good adhesion to the image receiving medium 12 when it is transferred onto the medium 12. Therefore, the flow point of the recording layer 3 is preferably within the range of $50\frac{1}{2}$° C. to $200\frac{1}{2}$° C. so that the recording layer 3 may become comparatively easily softened under heat from the heating roller 13. Generally, the flow point (fluidizing point) of the recording layer 3 is measured by a flow tester. Useful materials, other than the foregoing polymeric materials, for the recording layer 3 include, for example, hot melt-type materials such as waxes, resins and the like, which may be used alone or in mixture as required. Where the recording layer 3 is formed of only one of the above mentioned various kinds of polymeric materials, the flow point of the recording layer 3 corresponds to the characteristic value of that particular material. Where the recording layer 3 is formed of a mixture of plural kinds of such polymeric materials, the flow point of the recording layer 3 represents a value indicative of the fluidity of the layer 3 and not a characteristic value of a particular material in the mixed materials. The glass transition point represents a value indicative of the material that has lowest glass transition point among the mixed material.

According to the thermal transfer recording method of the invention, the recording layer 3 is transferred onto the image receiving medium for image formation. Therefore, the recording layer 3 must have light transmittable properties and is preferably formed from a colorless and transparent polymeric material.

The recording layer 3 may have various kinds of silicone, fluoroplastic, and fatty acid compounds, various kinds of surfactants, and various kinds of particles incorporated as additives therein for preventing the recording layer 3 from going into thermal adhesion contact with the ink material layer 6.

For the image receiving medium 12, non-coated and coated paper materials, such as wood-free paper, plain paper (for copying purposes, etc.), and bond paper; films, such as polyethylene, polypropylene (PP), polyethylene terephthalate (PET), and aluminum foils; and synthetic papers made principally from PP, PET or polyvinyl chloride may be used either in continuous form or in cut form and without limitation as to material, quality, form, etc.

In the foregoing embodiment, the recording layer 3 in the intermediate transfer member 4 is supplied as is precoated on the polymeric layer 2, and upon completion of transfer thereof, the base 1 and the polymeric layer 2 are both discarded. Alternatively, it may be arranged that the base on which the polymeric layer is formed is rolled up in endless fashion, and that upon completion of each transfer operation a recording layer is cyclically supplied by recording-layer-feeding means for placement onto the polymeric layer on the base.

Figure 5:
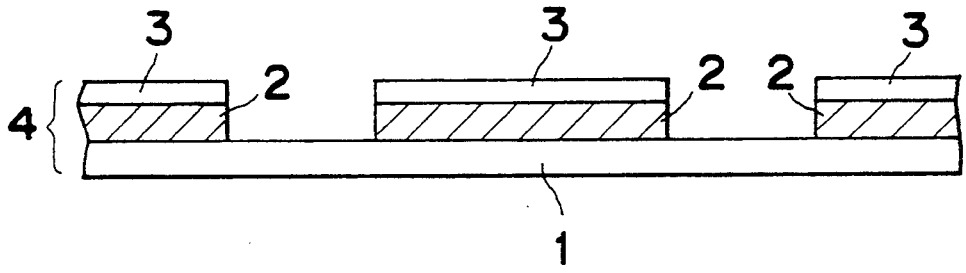
FIG. 5 is a sectional view showing by way of example the arrangement of an intermediate transfer member available for the purpose of the invention.
Figure 6:
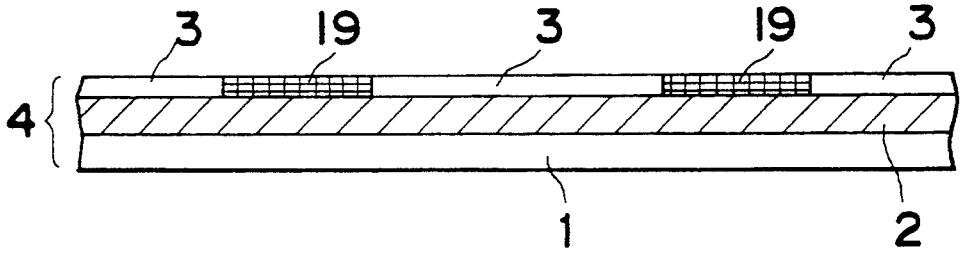
FIG. 6 is a sectional view showing by way of example another form of intermediate transfer member available for the purpose of the invention.

In the embodiment, the intermediate transfer member 4 has a polymeric layer 2 and a recording layer 3 each formed in continuous fashion on the base 1. It is understood that the intermediate transfer member of the invention is not limited to this arrangement. It is possible to use an intermediate transfer member of the form shown in FIG. 5 wherein polymeric layers 2 and recording layers 3 are disposed on the base 1 in selected regions necessary for recording. It is also possible to arrange that the intermediate transfer member 4 has a polymeric layer 2 formed continuously on the base 1, and recording layers 3 formed on the polymeric layer 2 in selected regions necessary for recording. With such an intermediate transfer member 4, wherein portions of the polymeric layer 2 on which no recording layer 3 is present are exposed, the portions of the adherent polymeric layer 2 may adhere to mechanical parts within the apparatus in operation, with the result that satisfactory run of the intermediate transfer member 4 may be prevented. In case of such a trouble, as FIG. 6 shows, it may be arranged that a polymeric layer 2 is formed continuously on the base 1 and recording layers are formed on the polymeric layer 2 in selected regions necessary for recording, with a protective layer 19 formed on each of those portions of the polymeric layer 2 which are not covered with recording layers 3.

Figure 7:
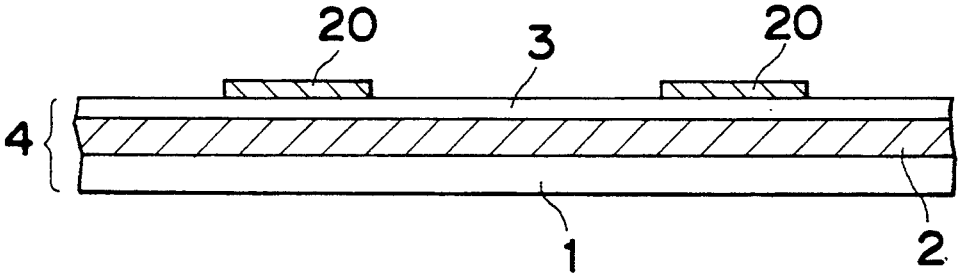
FIG. 7 is a sectional view showing by way of example still another form of intermediate transfer member available for the purpose of the invention.

Also, as FIG. 7 shows, the intermediate transfer member may be of such an arrangement that a polymeric layer 2 and a recording layer 3 are continuously formed on the base 1, there being formed transfer preventive layers 20 on those portions of the recording layer 3 which are not necessary for recording purposes. By so arranging is it possible to insure that during the process of transferring recording layers 3 onto an image receiving medium 12, the portions of recording layer 3 which are not necessary for recording purposes will not be transferred onto the image receiving medium because of the presence of the transfer preventive layers 20, and that only the portions of those recording layer 3 which are necessary for recording will be transferred onto the image receiving medium 12. This arrangement also permits easy fabrication of an intermediate transfer layer because it eliminates the necessity of pattern registration between the polymeric layer 2 and the recording layer 3 as required in the case where an intermediate transfer layer of the FIG. 5 arrangement is fabricated. Further, it is possible to arrange that the transfer preventive layer 20 is formed of a material which is impervious to light for provision of means for locating a record starting point via a transmission-type or reflection-type photosensor.

In the embodiment, the base and polymeric layer of the intermediate transfer member are structured in such a way that the polymeric layer is formed on the sheet form base which is comprised of plastic material or the like; In another form, a polymeric layer may be formed on a drum-like base comprised of plastic material or the like. Where such a drum-like base is used, the arrangement of the intermediate transfer member is such that upon completion of each transfer operation, a recording layer is supplied onto the drum-like base, that is, a recording layer is repetitively so supplied. The drum-like base has a heat generating section provided therewithin, so that it concurrently serves as the platen 8 and heating roller 13 shown in FIG. 1. In that case, the transfer means for transferring the recording layer onto an image receiving medium is constituted of the heat generating section and the roller 14.

Instead of providing a polymeric layer on the sheet-form base, a sheet-form heat resistant base having rubber elasticity and self-adhering property may be used. In this case, the base has, in addition to its function as such, the function of the polymeric layer as well, and this eliminates the need for provision of a polymeric layer. For the sheet-form heat resistant base having rubber elasticity and self-adhering property, a fluoro-based or silicone-base film, for example, which has a self-adherent material incorporated therein may be used. In particular, silicone rubber, fluoro-silicone rubber sheets having a silicone adhesive incorporated therein are useful for the purpose. In the case where a sheet-form heat resistant base having rubber elasticity and self-adhering property is used, if the degree of its longitudinal expansion and contraction is unignorably great, it is desirable to arrange that a polymeric layer is formed on the base.

For the rubber elasticity of the polymeric layer 2, it is desirable that the material of the layer is highly resilient and is not liable to any appreciable change in its elasticity when exposed to pressure and heat. For this purpose, silicone materials having high heat resistance are useful. More particularly, silicone 10 materials in the form of elastomer, gel, or flexible resin can be advantageously used. The use of an elastomer-like silicone rubber provides good rubber elasticity with high heat resistance, weathering resistance and chemical resistance. Examples of such silicone rubbers include those from the process of curing in a condensation reaction, such that an organopolysiloxane having several alkoxyl groups or the like at its terminal has been turned into an elastomeric material through dealcoholizing condensation with airborne moisture in the air, or such that an organopolysiloxane having several acetoxyl groups or the like at its terminal has been turned into an elastomeric material through deacetylating condensation with moisture in the air, and those produced by such a process that an aliphatic unsaturated group, such as a vinyl group linked to a silicone atom of organopolysiloxane has been cured with an organohydrogen polysiloxane through an addition reaction in the presence of catalyst based on noble metal, such as a platinum compound catalyst. The latter mentioned type of silicone rubber has advantages that it can become cured at low temperatures and in a short time period, resulting in good productivity, and that it is not liable to produce any by-product during the process of curing. Such a silicone material can be advantageously used in forming a polymeric layer 2 which is flexible enough to become fixed conforming to any surface irregularity of an image receiving medium 12. The provision of such a flexible polymeric layer 2 enables the recording layer 3 to be well received into surface depressions of the image receiving medium 12, and this provides for increased adhesivity, which in turn results in improved fixation effect. As the measure of rubber elasticity of a polymeric layer 2 it may be noted that rubber hardness of the material be selected within the range of $10\frac{1}{2}$ to $70\frac{1}{2}$, which will provide satisfactory fixation effect. Especially where the rubber hardness is $10\frac{1}{2}$ to $25\frac{1}{2}$, excellent fixation effect can be obtained even when the image receiving medium 12 has a greater surface irregularity. Where a silicone material is to be used for the polymeric layer, it is desirable to select a silicone for release-paper which is of low rubber hardness and is easily curable.

Where an adhesive material is to be used for the polymeric layer 2 or for imparting self-adhering properties to the polymeric layer 2, rubber-based, acrylic resin-based, and silicone-based adhesive materials are useful for the purpose. Useful rubber-based adhesive materials may be those composed principally of rubbers such as natural rubber, synthetic rubber, styrene-butadiene rubber, thermoplastic rubber, or butyl rubber, with rosin, rosin derivatives, terpene resin or the like added as a tackifier. Useful adhesive materials based on acrylic resins may be those composed principally of 2-ethylhexyl acrylate, 2-butyl acrylate or the like and copolymerized with methyl acrylate, ethyl acrylate, methyl methacrylate, vinyl acetate, acrylic acid, methacrylic acid, acrylamide derivatives, hydroxyethyl acrylate, glycidyl acrylate or the like. Silicone adhesive materials are highly cohesive and have good adherence characteristics. By using a silicone pressure sensitive adhesive material having high cohesive force is it possible to insure that a recording layer 3 formed on a polymeric layer 2 will be stably held on the polymeric layer 2 with no possibility of the layer 3 slipping out of position, during the process of recording or during storage. A silicone pressure sensitive adhesive material is composed of silicone rubber as a film forming material; silicone resin as a self-adhering material; and other material, such as filler, plasticizer, additive, or the like. Because of its high heat resistance and good adherent characteristics, it can be advantageously used as a self-adherent silicone material for the purpose of the invention. Examples of useful silicone raw rubbers include high-polymeric organopolysiloxanes containing monomer units of dimethyl siloxane, diphenyl siloxane, methyl vinyl siloxane, phenyl methyl siloxane, or halogenated products thereof; and those organopolysiloxanes which have further a functional group, such as hydroxyl group, as a terminal group. Examples of useful silicone resins include diorganopolysiloxanes having a methyl, ethyl, propyl, vinyl, or phenyl group, or a halogenated product of any of these groups; and those diorganopolysiloxanes which have further a hydroxyl or trimethyl siloxyl group as a terminal group. Among these silicone adhesive compounds those produced through a process such that an aliphatic unsaturated group, such as a vinyl group linked to a silicon atom of organopolysiloxane has been cured with an organohydrogen polysiloxane through an addition reaction in the presence of a noble metal-based catalyst, such as a platinum compound catalyst can be advantageously used because they become cured at low temperatures and in a short time period, resulting in high productivity, and because they are not liable to produce any by-product in the course of curing. Such a silicone pressure sensitive adhesive is changeable in its characteristics, such as adhesion strength, cohesive force, and tackiness, in various ways by changing proportions of silicone raw rubber and silicone resin, as well as by changing kinds and amounts of additives. Such a silicone pressure sensitive adhesive can have both good self-adhering property and good rubber elasticity. This permits the polymeric layer 2 to be formed from a silicone pressure sensitive adhesive alone.

When it is desired to provide a polymeric layer 2 having increased mechanical strength and increased heat resistance, or control the surface characteristics of the polymeric layer 2, use of additives is effective for the purpose. Useful additives include inorganic substances in particular form, such as silica, alumina, red oxide, and titanium oxide, and organic materials of comparatively low molecular weight, such as silicone oil and the like.

The polymeric layer 2 should preferably be made as thick as possible so as to permit itself to be sufficiently deformed conforming to the surface irregularity of an image receiving medium. If the image receiving medium has a relatively rough surface, as in bond paper, its surface depressions are generally about 10 Ìm deep, and deepest of them may be of the order of 25 Ìm. Therefore, a layer thickness of more than 10 Ìm enables transfer to be effected even if the image receiving medium 12 has considerable surface irregularity; and a layer thickness of more than 25 Ìm will enable satisfactory fixation effect to be obtained. Where plain paper is used, a layer thickness of about 10 Ìm can provide for sufficient fixation effect, because such paper has surface depressions which are much less deep than those in the case of bond paper.

In the foregoing embodiment, when the recording layer 3 is transferred onto the image receiving medium 12, heat is applied by the heating roller 13 from the base 1 side. However, where the recording layer 3 is formed of a material which can adhere to the image receiving medium 12 at room temperature, heating is unnecessary because the recording layer 3 can be transferred by pressure only onto the image receiving medium 12. This saves power consumption by the heater in the heating roller 13, resulting in reduced power consumption of the apparatus as a whole.

According to the thermal transfer recording method of the invention described above, it is possible to obtain a uniform image irrespective of the type of recording paper used as an image receiving medium, i.e., plain paper, OHP transparent film, bond paper having rough surface, coated paper, or coated film. More particularly, according to the method of the invention, high image quality recording can be achieved using plain paper as an image receiving medium. Such a recording has hitherto been almost impossible even with the sublimation type recording method known as a high-quality recording technique.

The following examples are given to further illustrate the method of the invention.

Example 1

To prepare an intermediate transfer member, a coating composition containing polyvinyl butyral (BL-S, made by Sekisui Chemical Co., Ltd.) was applied by a wire bar on a polyethylene terephthalate (PET) film having a thickness of about 25 Ìm. The coating was then dried to form a recording layer having a thickness of about 3 Ìm. This recording layer was separated from the PET film and mounted on an adhesive surface of a 12-mm wide mending tape (MD-12C, made by Nichiban Co., Ltd.), and the resulting laminate was used as an intermediate transfer member. In this case, an acrylic resin-based adhesive material coated on the surface of the mending tape served as a polymeric layer, and the adhesive material was soft and had adherence.

An ink sheet available in the market for a video printer (NV-MPI, made by Matsushita Electric Industrial Co., Ltd.) was used. The ink sheet was placed on the intermediate transfer member so as for its cyan coloring material layer to contact the recording layer, and heat was applied by a small heater heated to about 180½° C., and from one side of the ink sheet which was opposite to the coloring material layer side. When the color sheet was separated from the intermediate transfer member, it was found that cyan dye had migrated into that part of the recording layer which was subjected to heat from the heater.

A copying sheet having a Bekk smoothness of 35 sec., as an image receiving medium, was placed on the recording layer of the intermediate transfer member, and the superposed set was passed through a fuser for a copying machine available in the market, being thereby heated. The intermediate transfer member and the copying sheet were withdrawn from the fuser and then cooled to room temperature. When the copying sheet was separated from the intermediate, the recording layer was found to have been transferred onto the copying sheet.

In this way, the process of image transfer to copying paper was ascertained by using an intermediate transfer member which utilizes, as a polymeric layer having rubber elasticity and self-adhering property, an acrylic resin-based adhesive material coated on a mending tape available in the market and has a recording layer comprised of polyvinyl butyral formed on the polymeric layer.

Example 2

To prepare an intermediate transfer member, a coating composition containing a gel-form silicone potting material (SE 1880, made by Toray—Dow Corning Silicone Co., Ltd.) was applied by a wire bar on a polyethylene terephthalate (PET) film having a thickness of about 25 Ìm, which coating was then dried to form a polymeric layer having a thickness of about 10 Ìm. This polymeric layer was very soft and its surface was self-adherent. A coating composition containing polyvinyl butyral (BL—S, made by Sekisui Chemical Co., Ltd.) was applied by a wire bar on the polymeric layer, which coating was then dried to form a recording layer having a thickness of about 3 Ìm. The resulting laminate was used as an intermediate transfer member.

An ink sheet similar to that used in Example 1 was used. The ink sheet and the intermediate transfer member was placed one over the other in the same way as in Example 1, and heat was applied partially from one side of the ink sheet which was opposite to the coloring material layer side. It was found that dye had migrated into that part of the recording layer which was subjected to heating.

A copying sheet having a Bekk smoothness of 35 sec., as an image receiving medium, was placed on the recording layer of the intermediate transfer member, and the superposed set was passed through a fuser for a copying machine available in the market. It was found that the recording layer had been transferred onto the copying sheet. The copying sheet could be more easily separated from the intermediate layer than in the case of Example 1.

Example 3

To prepare an intermediate transfer member, a coating composition containing a silicone for release paper (SD 7328, made by Toray—Dow Corning Silicone Co., Ltd.) and/or a silicone adhesive material (SD 4570, made by Toray—Dow Corning Silicone Co., Ltd.) was applied by a wire bar on a polyethylene terephthalate (PET) film having a thickness of about 25 Ìm. The coating was then dried at 130½° C. for 3 min. to form a polymeric layer having a thickness of about 25 Ìm. The composition of this polymeric layer is tabulated hereinbelow. For the polymeric layer, five kinds of compositions were prepared, including one consisting of silicone for release paper alone and one consisting of silicone adhesive material alone. Each polymeric layer thus formed was very flexible and had good rubber elasticity. Polymeric layers other than one formed of the silicone for release paper alone showed greater surface adherence in proportion as the silicone adhesive material content thereof increased. With respect to the polymeric layer formed of the silicone for release paper alone, however, the surface of the layer had little adherence.

A coating composition containing polyvinyl butyral (BL—S, made by Sekisui Chemical Co., Ltd.) was applied by a wire bar on each polymeric layer. The coating was then dried to form a recording layer having a thickness of about 3 Ìm. The resulting laminate was used as an intermediate transfer member.

| Sample No. | 1 | 2 | 3 | 4 | 5 |
|---|---|---|---|---|---|
| Silicone for release paper in wt parts (solid cont.) | 10 | 7.5 | 5 | 2.5 | 0 |
| Silicone adhesive material in wt parts (solid cont.) | 0 | 2.5 | 5 | 7.5 | 10 |

An ink sheet was formed by coating by a wire bar, on a PET film of about 4 Ìm in thickness having a heat resistant and lubricating layer on the underside thereof, a coating composition containing an azo disperse dye, saturated polyester resin, and a silicone-type releasing agent, then drying the coating, thereby forming an ink material layer having a thickness of about 1 Ìm.

Nextly, each of the five kinds of intermediate transfer members having polymeric layers of the above tabulated compositions respectively, and an ink sheet of the above construction were placed one over the other in such a way that the surface of recording layer was laid in face to face relation with the surface of the ink material layer. The superposed set was inserted between a thermal head subjected to a pressing force of about 50N and a platen. Recording was effected under the following conditions: recording speed: 8 ms/line; maximum pulse width: 4 ms; and maximum recording energy, 7 $J/cm^2$.

After recording was completed, the intermediate transfer member and the color sheet were cooled to room temperature, and then the ink sheet was separated from the intermediate transfer member. With respect to intermediate transfer members other than the one having its polymeric layer formed of silicone for release paper alone, it was found that the recording layer had a tone pattern clearly recorded thereon. In particular, good dot reproduction in highlight areas was observed, it being thus found that the thermal head, the ink sheet, and the recording layer on the intermediate transfer member had been held in good contact with one another. Recording could be stably effected free of the trouble of the recording layer peeling off the polymeric layer. In contrast, with the one intermediate transfer member formed of silicone for release paper alone, although good recording effect was obtained in highlight areas, it was found that the recording layer peeled off the polymeric layer, the recording layer being not sufficiently held in position by the polymeric layer.

Nextly, a copying sheet having a Bekk smoothness of 35 sec., as an image receiving medium, was mounted on the each recording layer of the five kinds of intermediate transfer members on which tone pattern had been recorded, and the superposed set was passed through the clearance between a rubber-coated surfaced metallic roller and a metallic roller. After removal thereof, the superposed set of intermediate transfer member and copying sheet was cooled to room temperature and then the copying sheet was separated from the intermediate transfer member whereby the recording layer was transferred onto the copying sheet. The rubber-coated metallic roller was of about 30 mm in diameter and had a temperature of about 100° C. A load of about 400N had been applied between the rubber-coated metallic rubber and the metallic roller.

For the purpose of transferring the recording layer onto the copying sheet, it was found with each of the five kinds of intermediate transfer members that the copying sheet could be separated from the intermediate transfer member. In each case, a high quality image was obtained such that the recorded image had dots of uniform configuration over the whole recorded density range of from low density to high density. The luster of the recorded layers was quite same as that of paper surface and almost free of unharmonious feel from the standpoint of image quality. The surface of the recorded layer had good write-on characteristics and was found to have been satisfactorily fixed. It was also found that in proportion as the silicone adhesive material content of the polymeric layer increased, greater force was required in separating the copying sheet from the intermediate transfer member.

Example 4

To prepare an intermediate transfer member, a coating composition containing a silicone for release paper (SD 7328, made by Toray—Dow Corning Silicone Co., Ltd.) and/or a silicone adhesive material (SD 4570, made by Toray—Dow Corning Silicone Co., Ltd.) in a solid content ratio of 1/1 was applied by a wire bar on a polyethylene terephthalate (PET) film. The coating was dried at 130° C. for 3 min. to form a polymeric layer having a thickness of about 70 μm. This polymeric layer was very soft and had good rubber elasticity.

The surface of the polymeric layer had sufficient tackiness and exhibited good adhesion to various surfaces including metal and resin film surfaces. A coating composition containing polyvinyl butyral (BL—S, made by Sekisui Chemical Co., Ltd.) was applied by a wire bar on the polymeric layer, and the coating was dried to form a recording layer having a thickness of about 3 μm. The resulting laminate was used as the intermediate transfer member.

Nextly, using an ink sheet having an ink material layer formed on a PET film which was prepared in same way as in Example 3, recording was effected by a thermal head with respect to the recording layer on the intermediate transfer member.

Upon completion of the recording, the intermediate transfer member and the color sheet were cooled to room temperature. Then, the ink sheet was separated from the intermediate transfer member, and it was found that a tonel pattern had been clearly recorded on the recording layer. In particular, good dot reproduction in highlight areas was observed, it being thus found that good contact had been maintained between the thermal head, the ink sheet, and the recording layer on the intermediate transfer member. Recording was stably effected free of the trouble of the recording layer peeling off the polymeric layer.

In this way, intermediate transfer members, each having a tone pattern recorded on its recording layer, were prepared in the total number of three.

Three kinds of image receiving mediums, including bond paper with a Bekk smoothness of 7 sec., a copying sheet having a Bekk smoothness of 35 sec., and a PET film having a thickness of 100 μm, were used. A recording layer was transferred onto each image receiving medium in the same way as in Example 3.

Transferred images on the respective image receiving mediums were of high quality and satisfactorily fixed. The luster of the recording layer was higher in the order of bond paper, copying sheet, and PET film. This typically reflected the surface conditions of the respective image receiving mediums. The recording layer on the copying sheet reproduced the surface condition of the paper more faithfully than the recording layer on the copying sheet in Example 3, thus involving less unharmonious feel from the standpoint of image quality. The surfaces of the respective recording layers on the bond paper and copying sheet had sufficient write-on characteristics.

Example 5

In same way as in Example 4, a polymeric layer containing a silicone for release paper and a silicone adhesive material, and a recording layer were formed on a PET film. The resulting laminate was used as an intermediate transfer member. Such intermediate transfer members were prepared in the total of two.

Nextly, in same way as in Example 3, an ink material layer was formed on a PET film, which laminate was used as an ink sheet.

Then, the ink sheet and each of the intermediate transfer members were placed one over the other in such a way that the ink material layer and the recording layer was laid in face to face relation, and the superposed set was inserted between the thermal head and the platen which were subjected to a pressing force of about 50N. Recording was carried out under the following conditions: recording speed, 8 ms/line; maximum recording pulse, 4 ms; and maximum recording energy, 7 J/cm$^2$.

With one of the intermediate transfer members, the temperature at the recording layer was controlled to 40° C., a temperature lower than the glass transition point, i.e., 54° C., of polyvinyl butyral, a component material of the recording layer. When the ink sheet was separated from the intermediate transfer member, it was found that a tone pattern had been clearly recorded on the recording layer. Good dot reproduction in highlight areas was observed as in Example 4. Recording was stably carried out free of the trouble of the recording layer becoming separated from the polymeric layer. It is noted that the room temperature was 28° C.

With the other of the intermediate transfer members, the temperature at the recording layer was controlled to 70° C., a temperature higher than the glass transition point, i.e., 54° C., of polyvinyl butyral, a component material of the recording layer. When the ink sheet was separated from the intermediate transfer member, the recording layer had been softened so that it was deformed due to its melt contact with the ink sheet, with some part of it floating up from the polymeric layer and some other part becoming peeled off the polymeric layer to go into adhesion contact with the ink sheet.

Example 6

In same way as in Example 4, a polymeric layer containing a silicone for release paper and a silicone adhesive material, and a recording layer were formed on a PET film. The resulting laminate was used as an intermediate transfer member.

Nextly, using an ink sheet prepared by forming an ink layer on a PET film in same way as in Example 3, recording was made by a thermal head on the recording layer on the intermediate transfer member.

After recording, the intermediate transfer member and the color sheet were cooled to room temperature and then the ink sheet was separated from the intermediate transfer member. As is the case with Example 4, it was found that a tone pattern had been clearly recorded on the recording layer. Such intermediate transfer members having a tone pattern recorded on the recording layer were prepared in the total of two.

Nextly, a copying sheet having a Bekk smoothness of 35 sec. was mounted on the recording layer on which a tone pattern had been recorded, and the superposed set was passed through the clearance between a rubber-coated metallic roller and a metallic roller, whereby the recording layer was transferred onto the copying sheet. The rubber-coated metallic roller was of about 30 mm in diameter. A load of about 400N had been applied between the rubber-coated metallic roller and the metallic roller.

With one of the intermediate transfer members, the temperature at the recording layer was controlled to about 90° C., a temperature lower than the flow point, i.e., 110° C., of polyvinyl butyral, a component material of the recording layer. When the intermediate transfer member was separated from the copying sheet, the recording layer was satisfactorily transferred onto the copying sheet. The transferred image on the copying sheet was of high image quality, with dots reproduced in uniform configuration throughout the whole density range of from low recording density to high recording density, as in Example 4. The gloss of the recording layer was not different from that on the surface of the paper and involve no unharmonious feel relative to image quality.

With the other of the intermediate transfer members, the temperature at the recording layer was controlled to about 160° C., a temperature higher than the flow point, i.e., 110° C., of the polyvinyl butyral, a component material of the recording layer. When the intermediate transfer member was separated from the copying sheet, the recording layer had been softened to a flowable extent so that some parts of it were cut off to remain as such on the polymeric layer as the recording layer was separated. The recording layer could not successfully be transferred onto the copying sheet.

Example 7

To prepare an intermediate transfer member, a coating composition containing a silicone adhesive material having an increased silicone rubber content and curable by addition reaction (SD 4567, made by Toray—Dow Corning Silicone Co., Ltd.) was applied by a wire bar on a polyethylene terephthalate (PET) film. The coating was dried at 130° C. for 3 minutes to form a polymeric layer having a thickness of about 70 μm. This polymeric layer was very soft and had good rubber elasticity. The surface of the polymeric layer had same degree of tackiness as the polymeric layer prepared in Example 4 and exhibited good adhesion to various surfaces including metal and resin film surfaces. The decrease in the number of constituent materials of the polymeric layer, as compared with Example 4, afforded greater ease in fabricating the polymeric layer.

A coating composition containing polyvinyl butyral (BL—S, made by Sekisui Chemical Co., Ltd.) was applied by a wire bar on the polymeric layer. The coating was applied to form a recording layer having a thickness of about 3 μm. The laminate thus formed was used as the intermediate transfer member.

Nextly, using an ink sheet having an ink material layer formed on a PET film which was prepared in same way as in Example 3, recording was effected by a thermal head with respect to the recording layer on the intermediate transfer member.

Upon completion of the recording, the intermediate transfer member and the color sheet were cooled to room temperature. Then, the ink sheet was separated from the intermediate transfer member, and it was found that a tone pattern had been clearly recorded on the recording layer. Recording was stably effected free of the trouble of the recording layer peeling off the polymeric layer.

Nextly, a copying sheet having a Bekk smoothness of 35 sec., as an image receiving medium, was mounted on the recording layer of the intermediate transfer member on which the tone pattern had been recorded. The superposed set was passed through the clearance between a rubber-coated metallic roller and a metallic roller. The intermediate transfer member and the copying sheet, after removed from the rollers, were cooled to room temperature. Thereafter, the copying sheet was separated from the intermediate transfer member whereby the recording layer was transferred onto the copying sheet. The rubber-coated metallic roller was of about 30 mm in diameter and had a temperature of about 100° C. A load of about 400N had been applied between the rubber-coated metallic roller and the metallic roller.

The transferred image on the copying sheet was found to be of high image quality as in Example 4, with dots of uniform configuration reproduced over the entire density range of low recording density to high recording density. The gloss of the recording layer was quite same as that of the paper surface and involved no unharmonious feel from the standpoint of image quality. The recording layer surface had write-on characteristics and was found to have been satisfactorily fixed.

Example 8

To prepare an intermediate transfer member, a polymeric layer containing silicone adhesive material and a recording layer were first formed on a PET film. A polyester adhesive tape (Nitto Denko K.K.) was mounted on portions of the recording layer which are not necessary for recording in such a way that the adhesive surface of the polyester adhesive tape lay in contact with the recording layer. The laminate thus formed was used as the intermediate transfer layer. The polyester adhesive tape was intended to serve as a transfer preventive layer relative to the recording layer, such that portions of the recording layer on which the tape was mounted, that is, the portions unnecessary for recording, were prevented from transferring onto an image receiving medium. The portions of the recording layer on which the tape was not mounted, that is, the portions needed for recording, had a total area corresponding to about one half of A 4 size.

Nextly, using an ink sheet having an ink material layer formed on a PET film which was prepared in same way as in Example 3, recording was effected by a thermal head with respect to the recording layer on the intermediate transfer member in same way as in Example 3.

Upon completion of the recording, the intermediate transfer member and the color sheet were cooled to room temperature. Then, the ink sheet was separated from the intermediate transfer member, and it was found that a tone pattern had been clearly recorded on the recording layer. Good dot reproduction in highlight areas was observed as was so in Example 7, it being thus found that good contact had been maintained between the thermal head, the ink sheet, and the recording layer on the intermediate transfer member. Recording was stably effected free of the trouble of the recording layer peeling off the polymeric layer.

Nextly, a copying sheet of A 4 size having a Bekk smoothness of 35 sec. was mounted on the recording layer on which the tone pattern had been recorded. The superposed set was passed through the clearance between a rubber-coated metallic roller and a metallic roller for transfer of the recording layer onto the copying sheet. The rubber-coated metallic roller was of about 30 mm in diameter and had a temperature of about 100° C. A load of about 400N had been applied between the rubber-coated metallic roller and the metallic roller.

In this case, those portions of the recording layer on which polyester adhesive tape was mounted as the transfer preventive layer were effectively prevented from contact with the copying sheet because of the presence of the polyester adhesive tape and remained as they are on the intermediate transfer member. Those portions of the recording layer which were used in recording had been transferred onto the copying sheet.

The transferred image on the copying sheet was found to be of high image quality as in Example 7, with dots of uniform configuration reproduced over the entire density range of low recording density to high recording density. The gloss of the recording layer was quite same as that of the paper surface and involved no unharmonious feel from the standpoint of image quality. The recording layer surface had write-on characteristics and was found to have been satisfactorily fixed. Edge portions of the transferred layer on the copying sheet, that is, the portions cut off from those portions of the recording layer which were not transferred onto the copying sheet because of the presence of the polyester adhesive tape, had been straightly and sharply cut.

What is claimed is:

1. A thermal transfer recording method comprising the steps of:

providing a ink sheet;

providing an intermediate transfer member comprising at least a base, a polymeric layer having rubber elasticity and self-adhering property, and a recording layer having dye-receptivity, laminated in this order on the base;

placing an ink material layer of said ink sheet on said recording layer;

thermally transferring dye from said ink material layer to said recording layer;

separating said ink sheet;

mounting an image receiving medium on said recording layer;

separating said image receiving medium to transfer said recording layer onto said image receiving medium from said intermediate transfer member.

2. The thermal transfer recording method as set forth in claim 1, wherein said polymeric layer having rubber elasticity and self-adhering property is comprised of a polymeric material having rubber elasticity and a polymeric material having self-adhering property.

3. The thermal transfer recording method as set forth in claim 2, wherein said polymeric material having rubber elasticity comprises a silicone material having rubber elasticity.

4. The thermal transfer recording method as set forth in claim 2, wherein said polymeric material having self-adhering property comprising a silicone material having self-adhering property.

5. The thermal transfer recording method as set forth in claim 4, wherein said silicone material having self-adhering property is a silicone pressure sensitive adhesive comprising silicone raw rubber and silicone resin.

6. The thermal transfer recording method as set forth in claim 1, wherein said recording layer comprises a thermoplastic resin with a glass transition point, and wherein in said step of separating said ink sheet, said ink sheet is separated from said recording layer in such a condition that the temperature of said recording layer is lower than said glass transition point.

7. The thermal transfer recording method as set forth in claim 1, wherein said recording layer comprises a thermoplastic resin with a flow point, and wherein in said step of separating said image receiving medium, said image receiving medium is separated in such a condition that the temperature of said recording layer is lower than said flow point.

8. The thermal transfer recording method as set forth in claim 1, wherein further comprising a transfer preventive layer partially formed on said recording layer so as to permit only necessary portions of said recording layer to be transferred onto said image receiving medium.

9. A thermal transfer recording method comprising the steps of:

providing an ink sheet;

providing an intermediate transfer member comprising at least a base, a polymeric layer consisting of a silicone material having rubber elasticity and self-adhering property, and a recording layer having dye-receptivity, laminated in this order on the base;

placing an ink material layer of said ink sheet on said recording layer;

thermally transferring dye from said ink material layer to said recording layer;

separating said ink sheet;

mounting an image receiving medium on said recording layer;

separating said image receiving medium thereby to transfer said recording layer onto said image receiving medium from said intermediate transfer member.

10. The thermal transfer recording method as set forth in claim 9, wherein said silicone material having rubber elasticity and self-adhering property is comprised of a silicone material having rubber elasticity and a silicone material having self-adhering property.

11. The thermal transfer recording method as set forth in claim 10, wherein said silicone material having self-adhering property is a silicone pressure sensitive adhesive comprising silicone raw rubber and silicone resin.

12. The thermal transfer recording method as set forth in claim 9, wherein said recording layer comprises a thermoplastic resin with a glass transition point, and wherein in said step of separating said ink sheet, said ink sheet is separated from said recording layer in such a condition that the temperature of said recording layer is lower than said glass transition point.

13. The thermal transfer recording method as set forth in claim 9, wherein said recording layer comprises a thermoplastic resin with a flow point, and wherein in said step of separating said image receiving medium, said image receiving medium is separated in such a condition that the temperature of said recording layer is lower than said flow point.

14. The thermal transfer recording method as set forth in claim 9, further comprising a transfer preventive layer partially formed on said recording layer so as to permit only necessary portions of said recording layer to be transferred onto said image receiving medium.

15. A thermal transfer recording method comprising the steps of:

providing an ink sheet;

providing an intermediate transfer member comprising at least a base, a polymeric layer consisting of a silicone pressure sensitive adhesive containing silicone rubber and silicone resin, and a recording layer having dye-receptivity, laminated in this order on the base;

placing an ink material layer of said ink sheet on said recording layer;

thermally transferring dye from said ink material layer to said recording layer;

separating said ink sheet;

mounting an image receiving medium on said recording layer;

separating said image receiving medium to transfer said recording layer onto said image receiving medium from said intermediate transfer member.

16. The thermal transfer recording method as set forth in claim 15, wherein said recording layer comprises a thermoplastic resin with a glass transition point, and wherein in said step of separating said ink sheet, said ink sheet is separated from said recording layer in such a condition that the temperature of said recording layer is lower than said glass transition point.

17. The thermal transfer recording method as set forth in claim 15, wherein said recording layer comprises a thermoplastic resin with a flow point, and wherein in said step of separating said image receiving medium, said image receiving medium is separated in such a condition that the temperature of said recording layer is lower than said flow point.

18. The thermal transfer recording method as set forth in claim 15, further comprising a transfer preventive layer partially formed on said recording layer so as to permit only necessary portions of said recording layer to be transferred onto said image receiving medium.

* * * * *

UNITED STATES PATENT AND TRADEMARK OFFICE

CERTIFICATE OF CORRECTION

PATENT NO. : 5,398,051

DATED : March 14, 1995

INVENTOR(S) : Yasuo FUKUI et al.

It is certified that error appears in the above-indentified patent and that said Letters Patent is hereby corrected as shown below:

Please change the second inventor's name from "Soichirou MIMA" to --Soichiro MIMA--.

Signed and Sealed this

Thirtieth Day of May, 1995

*Attest:*

*Attesting Officer*

BRUCE LEHMAN

*Commissioner of Patents and Trademarks*